US007494705B1

(12) United States Patent
Sheridan et al.

(10) Patent No.: US 7,494,705 B1
(45) **Date of Patent: *Feb. 24, 2009**

(54) HYDRIDE BASED NANO-STRUCTURED ENERGY DENSE ENERGETIC MATERIALS

(75) Inventors: Edward W. Sheridan, Orlando, FL (US); John Jones, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 195 days.

This patent is subject to a terminal disclaimer.

(21) Appl. No.: 10/759,885

(22) Filed: Jan. 15, 2004

Related U.S. Application Data

(60) Provisional application No. 60/440,549, filed on Jan. 15, 2003.

(51) Int. Cl.
*C06B 27/00* (2006.01)
*B32B 7/00* (2006.01)
*B32B 15/00* (2006.01)

(52) U.S. Cl. ..... 428/336; 428/607; 428/632; 428/655; 428/701; 149/14

(58) Field of Classification Search ..... None
See application file for complete search history.

(56) References Cited

U.S. PATENT DOCUMENTS

| | | | | | |
|---|---|---|---|---|---|
| 4,119,036 | A * | 10/1978 | Hayashi et al. | ..... | 102/374 |
| 5,266,132 | A * | 11/1993 | Danen et al. | ..... | 149/15 |
| 5,439,537 | A * | 8/1995 | Hinshaw et al. | ..... | 149/22 |
| 6,192,802 | B1 * | 2/2001 | Baginski | ..... | 102/202.2 |
| 6,224,099 | B1 * | 5/2001 | Nielson et al. | ..... | 280/741 |
| 6,534,194 | B2 * | 3/2003 | Weihs et al. | ..... | 428/635 |
| 6,772,692 | B2 * | 8/2004 | Baginski et al. | ..... | 102/202.7 |
| 2001/0046597 | A1 * | 11/2001 | Weihs et al. | ..... | 428/336 |
| 2002/0092438 | A1 * | 7/2002 | Makowiecki et al. | ..... | 102/205 |
| 2004/0060625 | A1 * | 4/2004 | Barbee et al. | ..... | 149/15 |
| 2004/0265214 | A1 * | 12/2004 | Anderson | ..... | 423/579 |
| 2005/0189050 | A1 * | 9/2005 | Sheridan | ..... | 149/15 |
| 2006/0053970 | A1 * | 3/2006 | Dreizin et al. | ..... | 75/354 |
| 2007/0277914 | A1 * | 12/2007 | Hugus et al. | ..... | 149/19.92 |

* cited by examiner

*Primary Examiner*—Keith D Hendricks
*Assistant Examiner*—Jason L Savage
(74) *Attorney, Agent, or Firm*—Jeffrey D. Myers; Peacock Myers, P.C.; Timothy D. Stanley

(57) ABSTRACT

An energy dense energetic material comprising a layer of material comprising one or more metals substantially not in oxide form and a layer of material comprising one or more metals substantially in oxide form, wherein the layers in combination are energetic and have a thickness of less than or equal to approximately 100 nm.

16 Claims, 2 Drawing Sheets

HYDRIDE BASED NANO-STRUCTURED ENERGY DENSE ENERGETIC MATERIALS

CROSS-REFERENCE TO RELATED APPLICATIONS

This application claims the benefit of the filing of U.S. Provisional Patent Application Ser. No. 60/440,549, entitled "Hydride Based Nano-Structured Energy Dense Energetic Materials", filed on Jan. 15, 2003, and the specification thereof is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to methods, compositions, and apparatuses for energetic reactions.

2. Description of Related Art

The purpose of the invention is to increase the amount of energy per unit volume of energetic material over conventional CHNO based explosives. Traditional mixed powder thermite type compositions are energetically dense but are limited in application due to the relatively slow reaction velocities and the amount of work energy available from the reaction.

BRIEF SUMMARY OF THE INVENTION

The present invention is of an energy dense energetic material comprising: a layer of material comprising one or more metals substantially not in oxide form; and a layer of material comprising one or more metals substantially in oxide form; and wherein the layers in combination are energetic and have a thickness of less than or equal to approximately 100 nm. In the preferred embodiment, the layers have a thickness of less than or equal to approximately 10 nm. Either or both types of layers can be present as a plurality of layers, preferably wherein each layer of material comprising one or more metals substantially in oxide form is adjacent to at least one layer of material comprising one or more metals substantially not in oxide form. The non-oxide layer(s) preferably comprise pure metal or compounds of one or more of Al, Ti, Li, and Mg. The oxide layer(s) preferably comprise compounds of one or more of W, P, Fe, and Mn. The non-oxide layer(s) may comprise one or more compositions from the group consisting of metal hydrides and metals with interstitial hydrogen. The material is preferably fabricated by plasma enhanced chemical vapor deposition and adhered to a substrate selected from polymers, ceramics, glass, metals, and curved surfaces. The layers may form, for example, an energetic material such as TNT, RDX, Tritonal, or AFX-757. The material may form energetic fragments upon detonation, such as elemental Mn or elemental P. The material may be made to be useful in an anti-tamper device.

The invention is also of an energy dense energetic material comprising: a first layer of material, comprising one or more compositions selected from the group consisting of metal hydrides and metals with interstitial hydrogen; and a second layer of material, comprising one or more metals substantially in oxide form; and wherein the layers in combination are energetic and have a thickness of less than or equal to approximately 100 nm. In the preferred embodiment, the first layer comprises one or more metal hydrides and/or one or more metals with interstitial hydrogen.

The invention is further of a method of making an energy dense energetic material, comprising: depositing a layer of material comprising one or more metals substantially not in oxide form; and depositing an adjacent layer of material comprising one or more metals substantially in oxide form; and wherein the layers in combination are energetic and have a thickness of less than or equal to approximately 100 nm.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a class of nanostructured materials that have the characteristic of rapidly liberating thermal and mechanical energy upon initiation of a chemical reaction. The materials are constructed from alternating layers of a reactive metal (preferably in hydride form or with interstitial hydrogen) and a metal oxide such that a thermodynamically favored redox reaction can occur. The alternating layers are preferably less than 100 nm thick, most preferably less than 50 nm thick.

The fundamental problem addressed by the present invention is the requirement to increase the energetic yield from explosives in volume limited applications. Although thermite-type reactions are energetically dense compared to CHNO explosives, they liberate energy as heat and tend to release energy at a much slower rate. By decreasing the distance between the reactants and forming a gaseous reaction byproduct, both of these limitations are addressed by the present invention.

Energy Dense Explosives (EDE) are physically dense energetic material compositions that upon initiation deliver more energy per unit volume than conventional CHNO energetics. Examples are thermite/redox reactions ($M+NO_x \rightarrow MO_x+N$) and fuel air explosives. Problems with existing EDEs are that reaction velocities are limited by diffusion rate and that they are not efficient work generators. The present invention is another and new form of EDE that addresses the problems of existing EDEs.

The present invention liberates thermal energy through an oxygen rearrangement reaction between a reactive metal and a metal oxide. One example is the thermite reaction: $Fe_2O_3+2Al \rightarrow 2Fe+Al_2O_3$. The invention is capable of doing work by the liberation of a gaseous reaction product, such as hydrogen.

The limitation of the reaction velocity of energetic materials is overcome by using layered structures of reactants. The reactant layers should be on the order of tens of nanometers thick. Preferred thickness is dependent upon desired reaction rate and the specific reactants.

Figure 1:
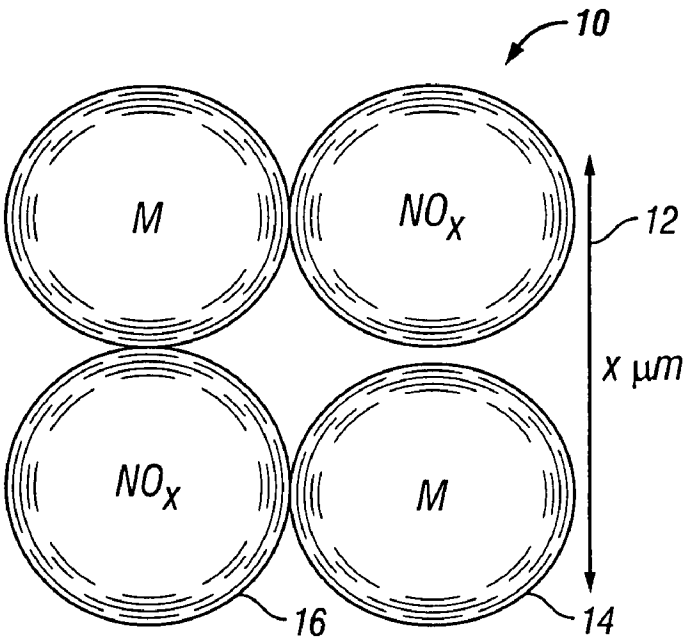
FIG. 1 (Prior Art)
FIG. 1 is a schematic diagram of the structure of prior art Energy Dense Explosives (EDEs)

Referring to FIG. 1, prior art EDE 10 comprises an array 12 of alternating metal 14 and metal oxide 16, with layers being microns or greater in thickness. The present invention provides a different pattern that reduces diffusion flux, given by the equation $J=(1/A)\ dm/dt$, where J is diffusion flux, M is mass, A is unit cross sectional area, and t is time.

Figure 2:
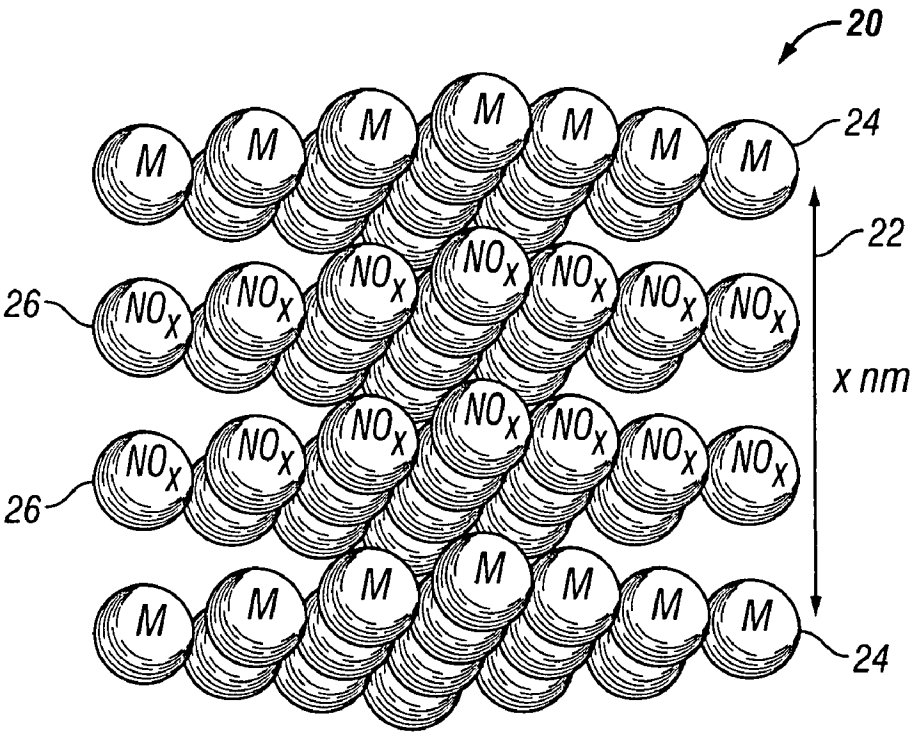
FIG. 2 is a schematic diagram of the structure of the EDEs of the present invention.

Referring to FIG. 2, the EDE 20 of the present invention comprises alternating layers 22 of metal 24 and metal oxide 26, with layers being less than 1 micron in thickness, preferably less than 100 nm, and most preferably less than 10 nm. The alternation is preferably, from bottom to top, metal layer, metal oxide layer, metal oxide layer, metal layer, repeated as necessary, but other alternatives are possible such as single thickness metal layer, double thickness metal oxide layer, and single thickness metal layer, or merely alternating double thickness layers of metal and metal oxide.

Figure 3:
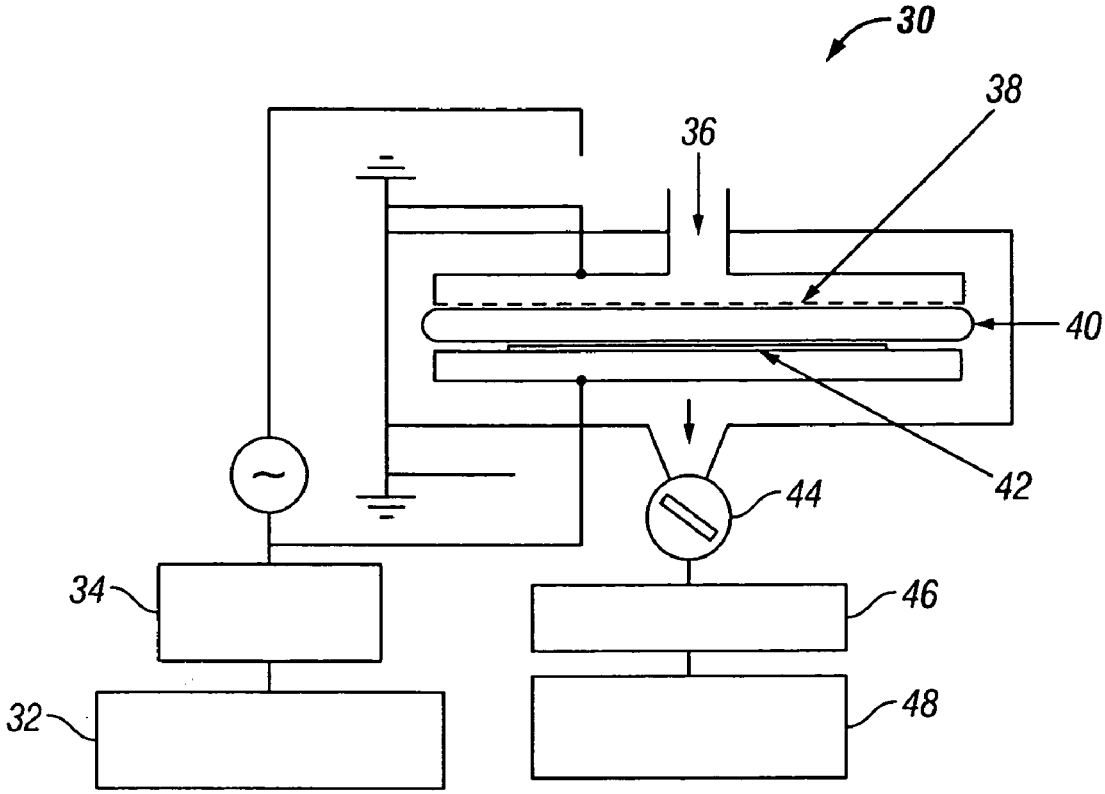
FIG. 3 is a schematic diagram of an apparatus useful in making the EDEs of FIG. 2.

FIG. 3 illustrates a plasma enhanced chemical vapor deposition (PECVD) apparatus 30 useful in making the EDEs of the invention. The apparatus preferably comprises power supply 32 (preferably RF 13.56 MHz), matching network 34, gas inlet 36, showerhead electrode 38, plasma 40, substrate 42, throttle valve 44, roots blower 46, and mechanical pump 48. This apparatus permits low temperature creation of the EDEs of the invention (less than 100 degrees C.), permits adhesion to polymers, ceramics, glass, and metals, and provides uniform coatings on curved surfaces.

Figure 4:
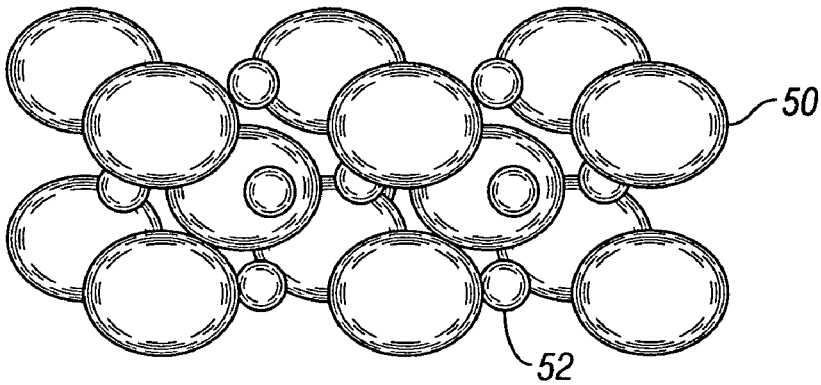
FIG. 4 is a schematic diagram of use of metal hydrides and/or hydrogen interstitials in the EDEs of FIG. 2 to increase work potential.

The limitation of available work energy of energetic materials is preferably overcome by using metal hydrides or solid solution interstitial hydrogen as one of the reactants. Upon initiation of the thermite reaction, for example, the hydrogen will be released as a hot gas. FIG. 4 shows a metal layer of FIG. 2 modified to incorporate this solution, with metal atoms 50 and hydrogen atoms 52. This provides for efficient packing of reactants. Table 1 shows the improvement in work potential provided to a T/W thermite reaction and as compared to trinitrotoluene (TNT).

TABLE 1

| Reaction | ΔHρ (kcal/cc) | mol gas/cc |
|---|---|---|
| $TNT \rightarrow CO_2 + CO + C + N_2 + H_2O$ | −1.79 | 0.049 |
| $Ti + WO_2 \rightarrow TiO_2 + W$ | −2.77 | 0 |
| $TiH_2 + WO_2 \rightarrow TiO_2 + W + H_2O$ | −3.6 | 0.033 |

To reiterate, the present invention is superior to powder-based EDE compositions because it allows for the rapid release of the reaction energy, an increased ability to perform mechanical work, and approaches theoretical maximum density, thus increasing the energy per unit volume.

The present invention is useful in creating enhanced conventional explosives. Examples are explosives using various reactive hydrides, such as $LiH_x$, $MgH_x$, $AlH_x$, and $TiH_x$, and/or various oxides, such as $P_2O_5$, $Fe_2O_3$, and $WO_2$, as well as explosives such as TNT with aluminum flakes (Tritonal), cyclotrimethylenetrinitramine (RDX), and AFX-757, an explosive fill used in the Joint Air-to-Surface Stand-off Missile (JASSM) and developed at Air Force Research Laboratory's Energetic Materials Branch. Such enhanced explosives can be designed as necessary for optimized cost, weight, heat, and work.

The present invention can also be used to make reactive fragments which are explosive and/or incendiary, with or without a tunable initiation. The following reaction is an example: $4AlH_x+3MnO_2 \rightarrow 2Al_2O_3+3Mn+xH_2O$.

The invention can additionally be used for agent defeat, using explosively generated phosphorus from stable reactants to generate reduced blast, high heat, and acidic byproducts. An example reaction is $AlH_x+P_2O_5 \rightarrow 0.5Al_2O_3+2P+xH_2O$.

The invention is further useful in creating anti-tamper devices providing controlled delivery of energy upon a custom triggering event. This can be used, for example, to protect sensitive designs from reverse engineering.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An energy dense energetic material comprising:

a layer of material comprising one or more metals substantially not in oxide form, comprising one or more compositions selected from the group consisting of metal hydrides and metals with interstitial hydrogen; and a layer of material comprising one or more metals substantially in oxide form; and wherein said layers in combination are energetic, reduce diffusion flux, and liberate a gaseous reaction product, and have a thickness of less than or equal to approximately 10 nm; and wherein energetic fragments forming upon detonation comprise a material selected from the group consisting of elemental Mn and elemental P.

2. The material of claim 1 comprising a plurality of layers of material comprising one or more metals substantially not in oxide form.

3. The material of claim 2 comprising a plurality of layers of material comprising one or more metals substantially in oxide form.

4. The material of claim 3 wherein each layer of material comprising one or more metals substantially in oxide form is adjacent to at least one layer of material comprising one or more metals substantially not in oxide form.

5. The material of claim 1 comprising a plurality of layers of material comprising one or more metals substantially in oxide form.

6. The material of claim 1 wherein the layer of material comprising one or more metals substantially not in oxide form comprises one or more metals selected from the group consisting of Al, Ti, Li, and Mg.

7. The material of claim 1 wherein the layer of material comprising one or more metals substantially in oxide form comprises one or more metals selected from the group consisting of W, P, Fe, and Mn.

8. The material of claim 1 wherein the layer of material comprising one or more metals substantially not in oxide form comprises one or more metal hydrides.

9. The material of claim 1 wherein the layer of material comprising one or more metals substantially not in oxide form comprises one or more metals with interstitial hydrogen.

10. The material of claim 1 fabricated by plasma enhanced chemical vapor deposition.

11. The material of claim 1 adhered to a substrate selected from the group consisting of polymers, ceramics, glass, metals, and curved surfaces.

12. The material of claim 1 wherein said layers form an energetic material selected from the group consisting of TNT, RDX, Tritonal, and AFX-757.

13. An energy dense energetic material comprising:

a first layer of material, comprising one or more compositions selected from the group consisting of metal hydrides and metals with interstitial hydrogen;

a second layer of material, comprising one or more metals substantially in oxide form; and wherein said first layer is disposed next to at least one said second layer and said first and second layers in combination are energetic and have a thickness of less than or equal to approximately 10 nm; and wherein energetic fragments forming upon detonation comprise a material selected from the group consisting of elemental Mn and elemental P.

14. The material of claim 13 wherein said first layer of material comprises one or more metal hydrides.

15. The material of claim 13 wherein said first layer of material comprises one or more metals with interstitial hydrogen.

16. A method of making an energy dense energetic material, the method comprising the steps of:

depositing a layer of material comprising one or more metals substantially not in oxide form, comprising one or more compositions selected from the group consisting of metal hydrides and metals with interstitial hydrogen; and depositing an adjacent layer of material comprising one or more metals substantially in oxide form; and wherein said layers in combination are energetic, reduce diffusion flux, and liberate a gaseous reaction product, and have a thickness of less than or equal to approximately 10 nm; and forming energetic fragments upon detonation comprising a material selected from the group consisting of elemental Mn and elemental P.

* * * * *